United States Patent [19]

Kass

[11] Patent Number: 4,866,868

[45] Date of Patent: Sep. 19, 1989

[54] DISPLAY DEVICE

[75] Inventor: Edward J. Kass, Skokie, Ill.

[73] Assignee: NTG Industries, Inc., Melrose Park, Ill.

[21] Appl. No.: 159,843

[22] Filed: Feb. 24, 1988

[51] Int. Cl.[4] ..... G09F 3/18

[52] U.S. Cl. ..... 40/661; 40/651

[58] Field of Search ..... 40/661, 652, 651, 658, 40/359, 5; 16/225

[56] References Cited

U.S. PATENT DOCUMENTS

| | | | |
|---|---|---|---|
| 781,222 | 1/1905 | Morse | 40/658 |
| 2,856,711 | 10/1958 | Hobbs | 40/651 |
| 4,295,288 | 10/1981 | Westberg | 40/661 |
| 4,334,372 | 6/1982 | Colmar | 40/5 |

OTHER PUBLICATIONS

Northtown Glass, "NTG Dominant Merchandising Systems", 1984.

J. C. Moag Company, "Ticket Assortments, Ticket Holders, Moldings and Shelf Rims".

*Primary Examiner*—Gene Mancene

*Assistant Examiner*—Cary E. Stone

*Attorney, Agent, or Firm*—Neuman, Williams, Anderson & Olson

[57] ABSTRACT

A display device is provided for containing an information card or ticket, securing the identification card to a structural member of a merchandising fixture and displaying the card to purchasers. The device is a one-piece construction extruded from a dual-durometer plastic. It includes a display segment with a cover for containing and displaying a card or ticket. The device also includes a support engaging segment with gripping ribs for engaging the edge portion of a support to releasably secure the device to the support.

7 Claims, 1 Drawing Sheet

DISPLAY DEVICE

BACKGROUND OF THE INVENTION

1. Field Of The Invention

This invention relates generally to a device for displaying an information card or ticket proximate a bin or a shelf on a store fixture. Specifically, it relates to a device which a user may releasably secure to the edge portion of a bin or shelf member. The device contains and displays an card or ticket which provides information regarding the contents of the bin or shelf.

2. Description Of The Prior Art

The retail trade uses a wide variety of fixtures, including bins and shelves which contain merchandise for sale. To identify the contents of these bins and shelves, indicate sizes and weights, or suggested retail prices, retailers use a variety of display devices which provide information relating to the merchandise. Typically, these devices include components which allow a user to secure the device to the store fixture.

A card display device should include features with which a user can easily secure it proximate a shelf or bin. It should also display the card so that a passer-by may easily read the written or printed matter on the card. Finally, a card display device should protect the card which it contains from damage and restrain it from falling off the device.

The prior art display devices suffer a number of disadvantages. First, some of these devices require that the bin or shelf to which a user mounts them have special grooving to receive them. In addition, some prior devices do not allow for quick and easy insertion and removal of the cards which they contain. Other prior devices do not securely engage the shelf or bin, allowing inadvertent removal of them from the desired position. Finally, still other prior devices are complex constructions which are difficult and expensive to manufacture.

The improved display device of the present invention overcomes the disadvantages of the prior art devices and provides a one-piece construction which minimizes the expense of manufacture and gives reliable performance. This construction includes components which secure the device to the edge portion of a structural member of a bin or shelf. It displays a card or ticket so that customers may easily observe the information provided by the card; and it covers the card to protect it and to restrain it from falling off the device.

SUMMARY OF THE INVENTION

It is, therefore, a general object of the present invention to provide an improved card display device.

It is a more specific object of this invention to provide an improved display device which securely engages an edge portion of a store fixture.

It is another object of the present invention to provide an improved display device which protects the card or ticket which it contains, displays the card effectively, and restrains it from falling off of the device.

It is yet another object of this invention to provide an improved display device with a one-piece construction which minimizes the expense of manufacture and gives reliable performance.

Other objects, advantages and features of the present invention will become apparent upon reading the following detailed description and appended claims, and upon reference to the accompanying drawings.

Accordingly, a display device which achieves the foregoing objects has a one-piece construction made by extruding or otherwise forming a suitable plastic, e.g., vinyl. It includes a hard, rigid body with a number of flexible portions.

To form this one-piece construction with rigid as well as flexible components, a manufacturer preferably extrudes the rigid portions using a hard vinyl material and the flexible portions using a soft vinyl. The manufacturer then brings the two materials together in the forming die where they bind together to form the one-piece construction.

The device includes a support engaging segment with first and second arms, spaced apart and disposed parallel to each other. These arms are rigid; and they receive an edge portion of a structural member of a store fixture in the space between them. They have flexible gripping ribs which project into this space. As the fixture member moves into the space between the arms, it bends the ribs towards their respective arms. Thus, the ribs lie wedged between the fixture member and the arm of which they are a part to releasably secure the device to the fixture member.

The display device also includes a display segment for supporting an information card or ticket. This display segment is flat and plate-like. It includes a rigid base portion, a rigid and transparent cover, and a flexible connecting portion which hingedly connects the cover to the base portion.

The flexible connecting portion allows a user to move the cover between a closed and an open position. In the closed position, the cover lies generally parallel to the base portion and covers it. In the open position, the cover allows the user to remove a card or ticket from the base portion or to place the card on the base portion. The flexible connecting portion also allows a user to secure the cover in the closed position. It allows the user to latch the edge of the cover under one leg of an L-shaped flange. This flange is a part of the base portion.

The display segment lies generally perpendicular to the support engaging segment and, accordingly, to the support member. Alternatively, the display segment may lie at any desirable angle to the support engaging segment. Furthermore, it may lie parallel to the support engaging segment. In this alternative, the support engaging segment has only one arm which cooperates with the back of the display segment to secure the device to the support member.

BRIEF DESCRIPTION OF THE DRAWINGS

For a more complete understanding of the present invention, one should now refer to the embodiments illustrated in greater detail in the accompanying drawings and described below as examples of the invention. In the drawings.

While this text describes the invention in connection with three embodiments, one should understand that the invention is not limited to these embodiments. Furthermore, one should understand that the drawings are not necessarily to scale and that the drawings illustrate the embodiments by graphic symbols and diagrammatic representations.

DETAILED DESCRIPTION OF THE DRAWINGS AND THE PREFERRED EMBODIMENTS

Figure 1:
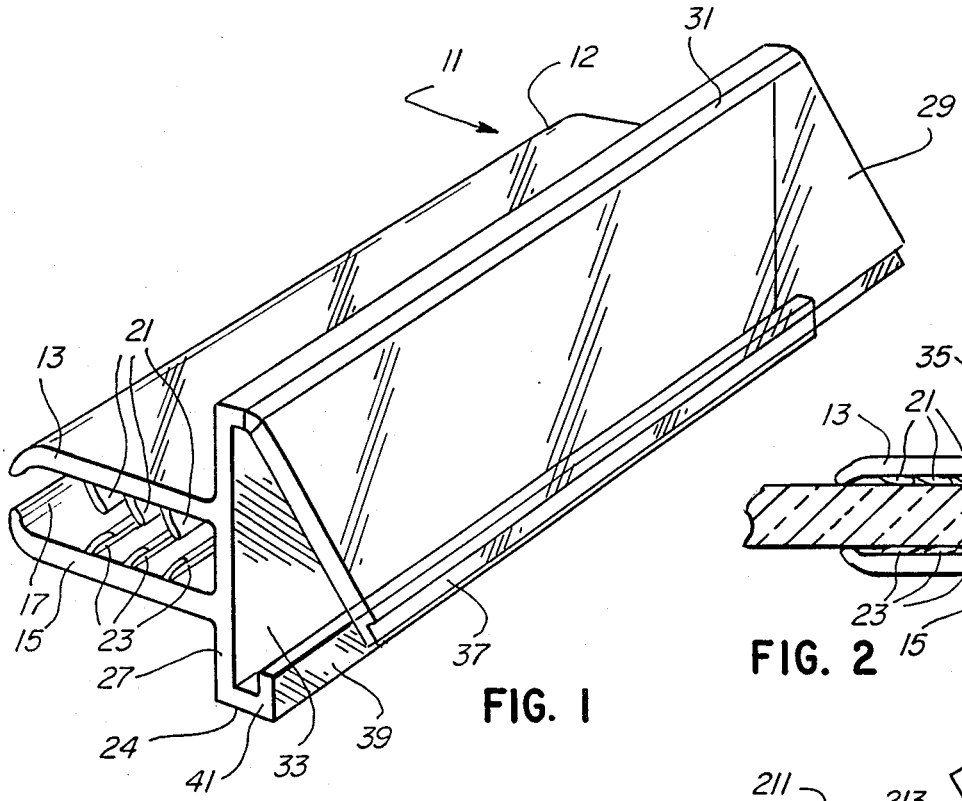
FIG. 1 is a perspective view of a first preferred embodiment of the display device of the present invention.

Turning now to the drawings, FIG. 1 shows a first preferred embodiment of the display device of the present invention generally at 11. This device is a one-piece construction made by extruding or otherwise forming a suitable plastic, e.g. vinyl. As shown in the following description, it includes a rigid body with a number of flexible portions.

To form this one-piece construction with rigid as well as flexible components, a manufacturer preferably extrudes the rigid portions using a hard vinyl material and the flexible portions using a soft vinyl. The manufacturer then brings the two materials together in the forming die where they bind together to form the one-piece construction.

The device includes a support engaging segment 12 with a first arm 13 and a second arm 15. These two arms, 13 and 15, lie generally parallel to each other and define a space 17 between them. They are hard and rigid; and they include flexible gripping ribs which project into the space 17.

The arm 13 has three gripping ribs 21 which extend across the width of the arm; and the arm 15 also has three gripping ribs 23 which similarly extend across the width of the arm 15. Alternatively, the first and second arms 13 and 15 may have a greater number of ribs; or they may have fewer than the three shown. In addition, rather than extend the full width of the arms, the ribs may extend only partially across the width of each arm.

Figure 2:
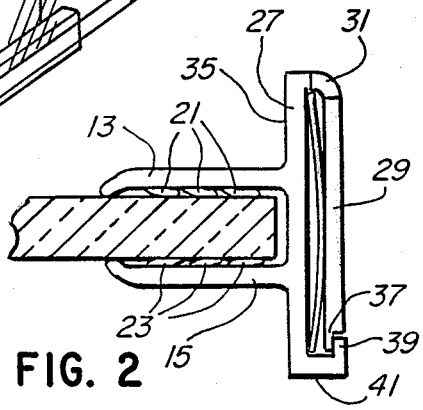
FIG. 2 is a side elevation view of the display device of FIG. 1, showing the device releasably secured to an edge portion of a glass shelf.

The device 11 receives, in space 17, the edge portion of a store fixture member, e.g., an edge portion of a glass shelf as shown in FIG. 2. As the fixture portion moves into the space 17 between the arms 13 and 17, it bends the ribs 21 and 23 toward the arms 13 and 15, respectively. Thus, the ribs lie wedged between the portion of the fixture and their respective arms to releasably secure the device to the fixture.

The device 11 also includes a display segment 24 disposed generally perpendicularly to the support engaging segment 12, i.e., the two arms 13 and 15. This display segment is flat and plate-like; and it includes a rigid base portion 27, a rigid and transparent cover 29, and a flexible connecting portion 31 which hingedly connects the base portion 27 and the cover 29.

The base portion 27 is a generally flat, plate-like, rectangular section with one surface 33 which receives and supports an information card or ticket (see FIG. 2) and an opposite surface 35 from which the arms 13 and 15 project. The cover 29 is also generally flat, plate-like and rectangular; and it has a configuration similar to that of the base portion 27.

The connecting portion 31 is an elongate strip disposed along one edge of the base portion 27. Its flexibility allows a user to move the cover 29 between a closed and an open position. In the closed position, the cover 29 lies generally parallel to the base portion 27 and covers the base portion. In the open position, the cover 29 allows the user to remove a card or ticket from the base portion 27 or place the card on the base portion. The connecting portion 31 also allows the cover 29 to shift in a direction parallel to the base portion 27 so that the user may latch an edge 37 of the cover 29 under a leg 39 of a flange 41. This flange 41 has an L-shaped cross-section. It is a part of the base portion 27; and it projects outward of the base portion 27 along the edge opposite the edge with the connecting portion 31.

Figure 3:
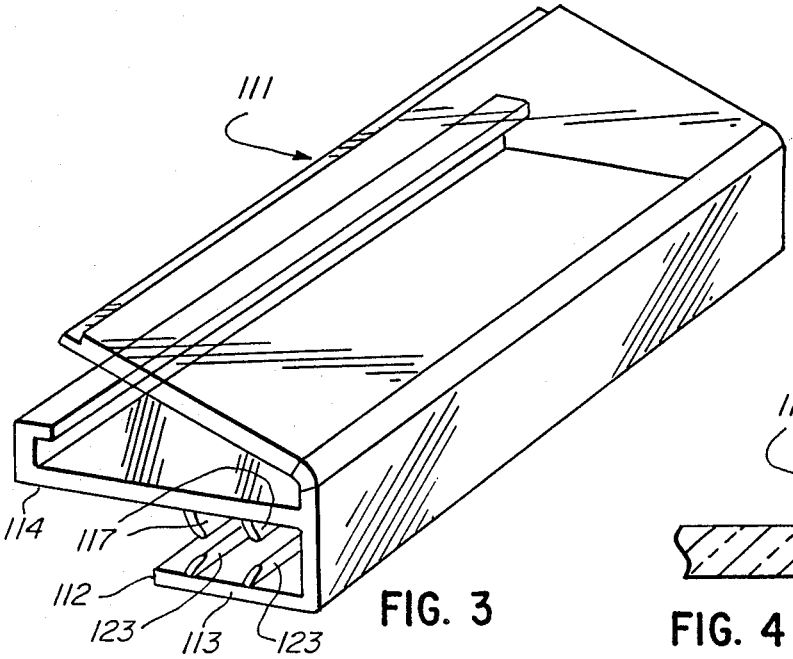
FIG. 3 is a perspective view of a second preferred embodiment of the display device of the present invention.
Figure 4:
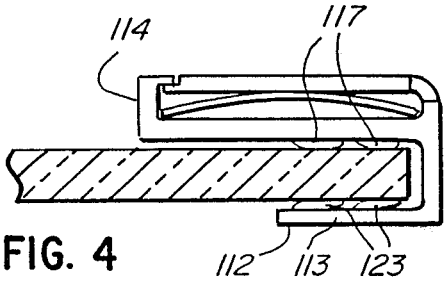
FIG. 4 is a side elevation view of the display device of FIG. 3, showing the device releasably secured to an edge portion of a glass shelf.

FIGS. 3 and 4 illustrate a second preferred embodiment of the display device of the present invention generally at 111. This device includes a support engaging segment 112 having an arm 113 which, along with a display segment 114, defines an opening 115 which receives an edge portion of a fixture member, e.g. the edge of a glass shelf (see FIG. 4). The display segment 114 is similar to the display segment of the first preferred embodiment. It differs in that it includes flexible ribs 117 which project outward of the surface opposite the surface which receives the information card and into the opening 115.

The arm 113 has an L-shaped cross-section. It includes gripping ribs 123 which project into the space 115. These gripping 123 and the ribs 117 are flexible and allow an edge portion of a store fixture member, e.g., a glass shelf, to enter into the space 115 as shown in FIG. 4.

This second embodiment 111, like the first preferred embodiment, is also a one-piece construction, extruded from a suitable plastic. It orients the card or ticket which it holds generally parallel to the store fixture member on which a user mounts this device.

Figure 5:
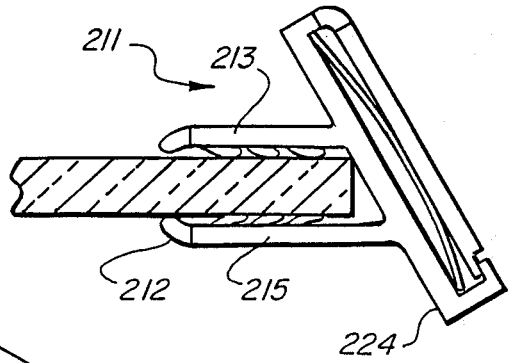
FIG. 5 is a side elevation view of a third preferred embodiment of the display device of the present invention secured to an edge portion of a glass shelf.

FIG. 5 shows a third preferred embodiment of the display device of the present invention generally at 211. This embodiment includes support engaging segment 212 with two arms 213 and 215 and a display segment 224. These segments are similar to the corresponding segments of the first preferred embodiment. However, the first arm 213 is shorter than the second arm 215, and the display segment 224 lies at an acute angle to the vertical.

Thus, the applicant has provided an improved card display device. This device engages the edge portion of a structural member of a store fixture and receives a card or ticket which it displays. It provides a construction which minimizes the expensive manufacture and allows a user to effectively display the card and protect it.

While the applicant has shown three embodiments of the present invention, one will understand, of course, that the invention is not limited to these embodiments, since those skilled in the art to which the invention pertains may make modifications and other embodiments of the principles of the invention, particularly upon considering the foregoing teachings. The applicant, therefore, by the appended claims, intends to cover any modifications and other embodiments which incorporate those features which constitute the essential features of this invention.

What is claimed is:

1. A one piece, integrally molded display device for receiving a card or ticket and securing said card to an edge portion of a structural member of a store fixture, said display device comprising:

securing means for engaging the structural member and releasably securing said display device to said structural member;

display means for supporting said card or ticket, said display means including at least a rigid, flat base member disposed to receive a card or ticket;

rigid transparent cover means for restraining said card on said base member and allowing said card to be viewed;

flexible, deformable joint means formed along one edge of said base member fastening an edge portion of said transparent cover means to the display means; and locking means disposed along one edge of said base member for releasably engaging and securing an opposing free edge of said cover means;

said joint means being deformable at least in a first direction allowing the reversible movement of said cover means from a closed position generally parallel to said base member to an open position in an angled relation to said base member and in a second direction allowing said cover to move generally parallel to said base member while being biased towards said base member to releasably secure said cover means with said locking means.

2. The display device of claim 1 wherein the locking means comprises a rigid L-shaped flange member formed along one edge of the base member of said display means, one leg of said L-shaped flange engaging an edge portion of the transparent cover means to releasably engage said cover means, said edge portion of the transparent cover being recessed to receive said leg of the L-shaped flange.

3. The display device of claim 1 wherein the rigid portions of said device are made from a hard vinyl material and the flexible portions of said device are made from a soft vinyl material.

4. The display device of claim 1, wherein said display means lies perpendicularly to said securing means.

5. The display device of claim 1, wherein said display means lies parallel to said securing means.

6. The display device of claim 1, wherein said securing means includes at least one support engaging arm with flexible gripping ribs for co-acting with said display means to engage said structural member.

7. A one piece, integrally molded display device for receiving a card or ticket and securing said card to an edge portion of a structural member of a store fixture, said display device comprising:

securing means for engaging the structural member and releasably securing said display device to said structural member;

display means for supporting said card or ticket, said display means including at least a rigid, flat base member disposed to receive a card to ticket, said base member having a base thickness;

rigid transparent cover means for restraining said card on said base member and allowing said card to be viewed, said cover means having a thickness substantially the same as the base thickness;

flexible, deformable joint means formed along one edge of said base member fastening an edge portion of said transparent cover means to the display means, said joint means having a thickness substantially the same as said base thickness;

locking means disposed along one edge of said base member for releasably engaging and securing an opposing free edge of said cover means; and said joint means being deformable at least in a first direction allowing the reversible movement of said cover means from a closed position generally parallel to said base member to an open position to an angled relation to said base member and in a second direction allowing said cover to move generally parallel to said base member while being biased towards said base member to releasably secure said cover means with said locking means.

* * * * *